United States Patent [19]

Parson

[11] 4,341,136

[45] Jul. 27, 1982

[54] FOOD PROCESSING MACHINE

[75] Inventor: Roger F. Parson, Duluth, Minn.

[73] Assignee: Jeno's, Inc., Duluth, Minn.

[21] Appl. No.: 181,817

[22] Filed: Aug. 27, 1980

[51] Int. Cl.[3] ..... B26D 3/22

[52] U.S. Cl. ..... 83/158; 83/268; 83/355; 83/409.2; 83/490

[58] Field of Search ..... 83/355, 356.1, 356.3, 83/411 A, 158, 490, 409.2, 268

[56] References Cited

U.S. PATENT DOCUMENTS

| | | | |
|---|---|---|---|
| 1,877,993 | 9/1932 | Senson | 83/490 |
| 3,291,168 | 12/1966 | Zitner | 83/411 A X |
| 3,322,010 | 5/1967 | Engel et al. | 83/411 A X |
| 3,515,190 | 6/1970 | Moriuchi | 83/490 X |
| 3,530,915 | 9/1970 | Moriuchi | 83/490 X |
| 3,842,698 | 10/1974 | Fitch et al. | 83/490 X |
| 3,867,858 | 2/1975 | Tsuchiya et al. | 83/411 A X |
| 3,972,256 | 8/1976 | Ross | 83/409.2 X |
| 4,177,703 | 12/1979 | Cavier et al. | 83/490 X |
| 4,188,845 | 2/1980 | Stukenberg | 83/356.1 |

*Primary Examiner*—Frank T. Yost

*Attorney, Agent, or Firm*—Richard G. Lione

[57] ABSTRACT

The machine includes a horizontal base plate on which a plurality of vertical tubes are mounted, apertures in said plate being disposed beneath said tubes so food products are free to pass down through the tubes and the plate. Stop means below the plate limit the distance which food products can extend out of the tubes. A blade assembly is rotatable below the plate on a vertical axis between the tubes. A blade assembly includes a freely rotatable circular blade at its outer end which passes under the tubes in sequence and cuts corresponding food products into predetermined length chunks.

2 Claims, 4 Drawing Figures

S
S
40
40
80
81
42
56
44
49
49
32
75
S
32
30
96
64
96
41
31
93
91
31
17
33
88
29
19
29
88
33
S
15
15
16
16

FOOD PROCESSING MACHINE

FIELD OF THE INVENTION

This invention is in the field of food handling machinery. It relates particularly to a machine for cutting up a food product such as pepperoni sausage or the like into "chunks".

BACKGROUND OF THE INVENTION

Commercial manufacturers of frozen pizza, for example, utilize a continuous process of dough base preparation and pizza crust formation. Pizza crusts are automatically topped with tomato sauce, cheese, ground meat, pepperoni, and other toppings considered desirable. Large quantities of these toppings are required to meet the demands of a manufacturer such as Jeno's, Inc., the assignee of this invention.

The present invention is concerned with those toppings which are originally obtained by the manufacturer in sausage form. Pepperoni sausage, Canadian bacon and salami, for example, are purchased by the manufacturer in two foot lengths with a diameter of between two and four inches. In order to facilitate preparation of the sausage slices from the sausage itself, it must first be broken down into sections or "chunks" several inches in length, which can then be handled by the dicing or slicing equipment.

Cutting sausages of pepperoni, Canadian bacon, salami, etc., into chunks has heretofore been done by hand or by conventional, band saw slicing machines. In the latter, the sausage is moved into engagement with a band saw blade. These known methods are labor intensive, time-consuming, and unsafe.

SUMMARY OF THE INVENTION

An object of the present invention is to provide a new and improved machine for "chunking" sausage like food products such as pepperoni, Canadian bacon, and salami sausages and the like. Another object is to provide a chunking machine which is effective to slice a sausage into a plurality of chunks without handling, other than initially, by an operator. It is still another object to provide a chunking machine which is effective to cyclically slice a plurality of sausages into chunks with only initial handling by the operator.

The foregoing and other objects are realized in accord with the present invention by providing a machine which consists of a stationary meat holder. The meat holder is made up of a plurality, usually four, of stainless steel tubes arranged in vertical position and spaced equally in a horizontal plane around a central, vertical axis. Each of the tubes are open at both top and bottom.

Positioned at a predetermined distance below the bottom opening of each tube is a sausage stop member. These stop members prevent the sausage from falling out of its tube once it is inserted and to control the length of the meat chunk to be cut off.

A blade assembly rotates around the center line of the machine in approximate alignment with the lower end of the tubes at a rate of approximately twenty (20) RPM. The blade assembly includes a circular blade which is free to rotate around its own center line displaced radially from the center line of the machine.

In operation, the blade assembly orbits around the center line of the machine. The blade sequentially cuts through each sausage as the assembly is carried orbitally around the axis of the machine. It will thus be seen that four chunks of sausage are cut off with each revolution of the blade assembly.

Attached to the blade assembly and following the leading edge of the rotating blade is a pusher member. The pusher member knocks each severed chunk of sausage from the position below a corresponding tube into a hopper. As the severed chunk is pushed from this position it permits the sausage to drop to the adjustable stop to position it for the next orbital rotation of the blade assembly.

The operator merely places a sausage or stick of meat in each of the four meat holders, places an empty meat truck hopper under the cutting unit, and energizes the machine. As each sausage or stick is cut up the operator inserts another into the corresponding holder.

BRIEF DESCRIPTION OF THE DRAWINGS

The invention, including its construction and method of operation, is illustrated in the accompanying drawings, in which.

DESCRIPTION OF THE PREFERRED EMBODIMENT

Figure 1:
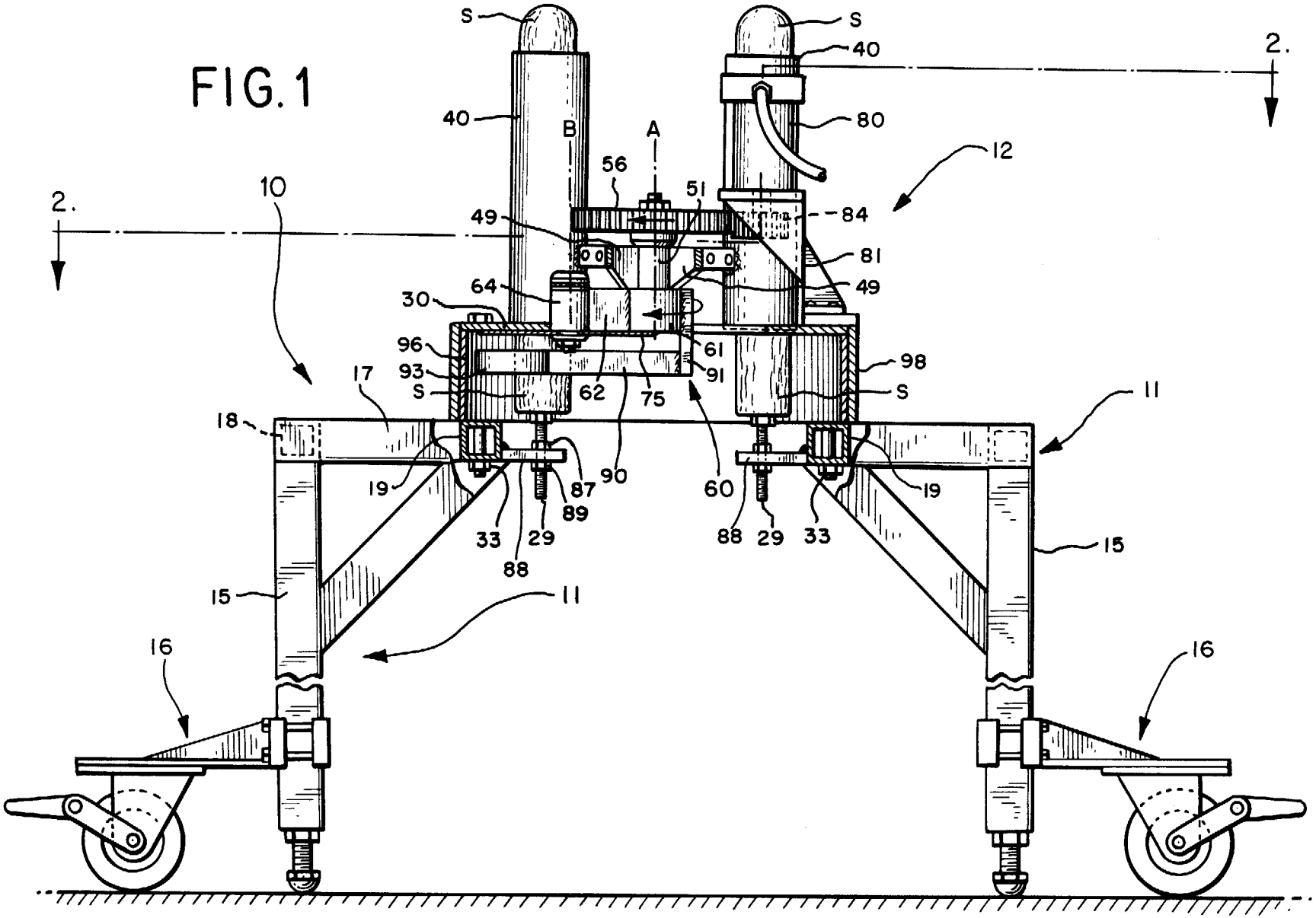
FIG. 1 is a front elevational view of the machine embodying features of the present invention.
Figure 2:
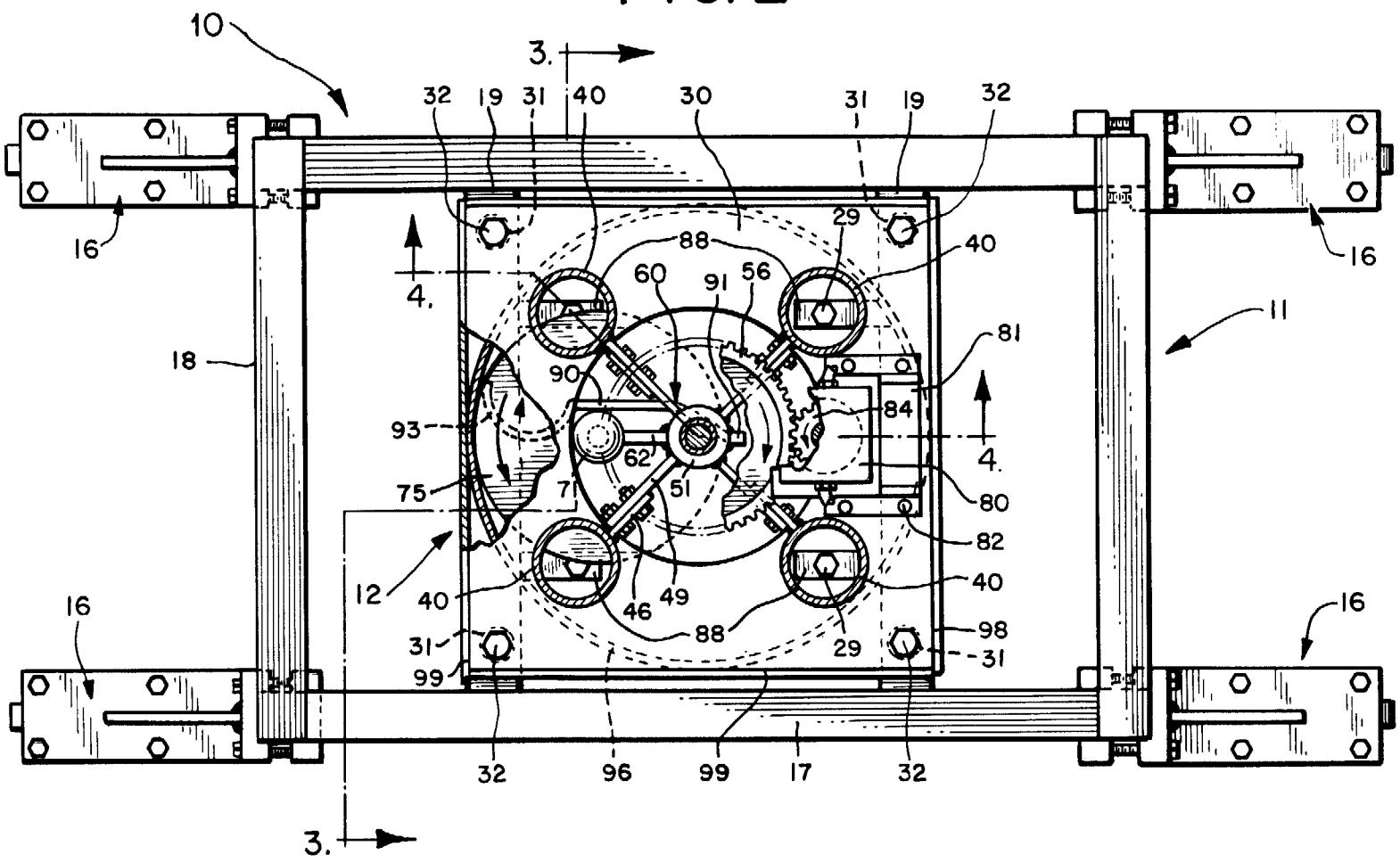
FIG. 2 is a top plan view of the machine.
Figure 3:
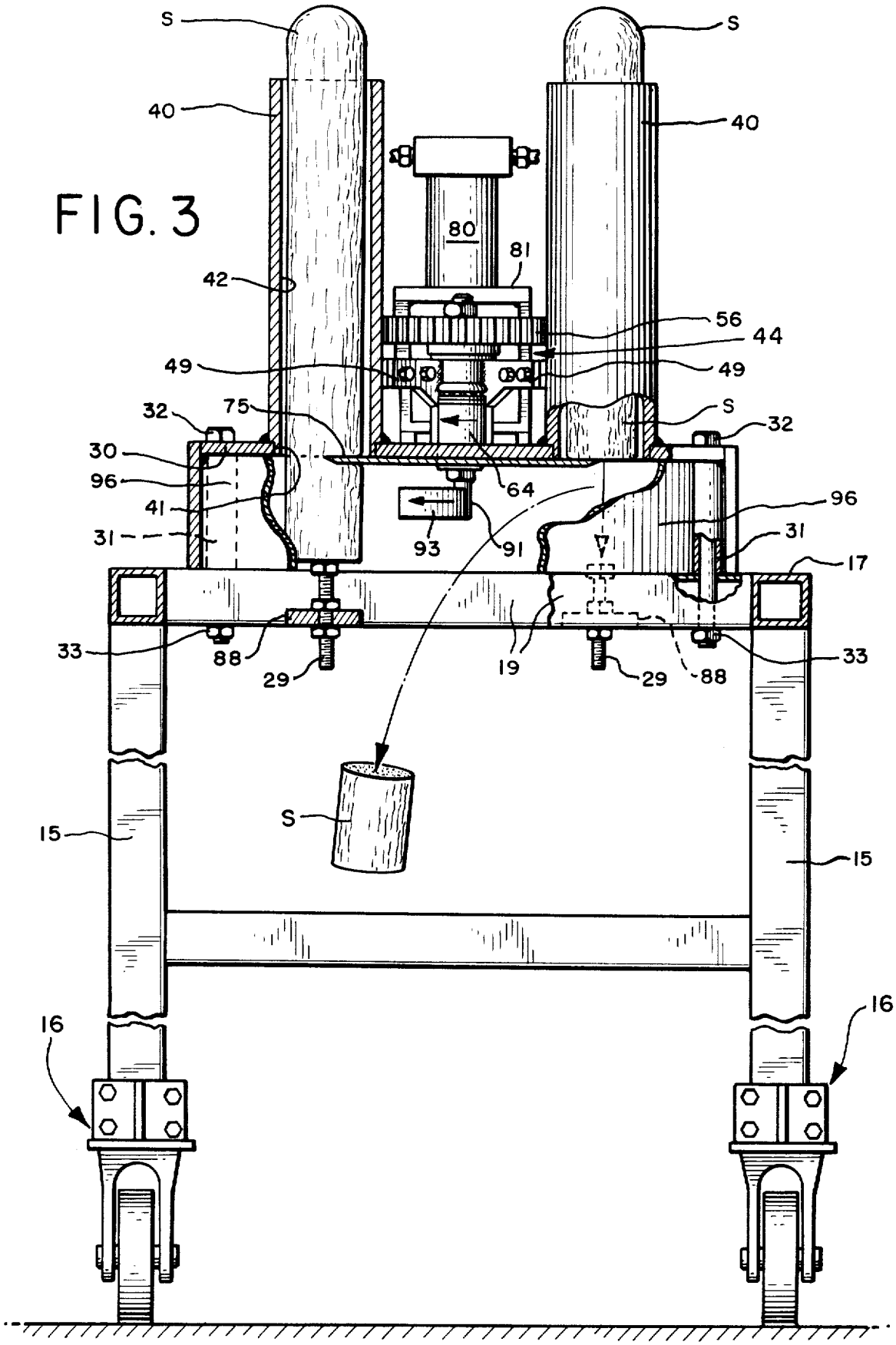
FIG. 3 is an end elevational view of the machine.

Referring now to the drawings, and particularly FIGS. 1—3, a machine for cutting food products such as sausage or the like into chunks and embodying features of the present invention is illustrated generally at 10. The machine 10 includes a generally rectangular base frame 11 upon which the cutting unit 12, itself, is mounted.

The base frame 11 is basically an open top table. It is fabricated of square steel tubing. It's vertical legs 15 are supported by individual support wheel assemblies 16. Upper side rails 17 and end rails 18 interconnect the legs 15. The cutting unit 12 is mounted between the side rails 17 on spaced intermediate rails 19 extending between the side rails.

The cutting unit 12 comprises a square base plate 30 which is supported above and from the intermediate members 19 by spacer sleeves 31 at each of its four corners. Bolts 32 extend downwardly through suitably formed apertures in the four corners of the plate 30, through the spacer sleeves 31, and through corresponding apertures formed in the intermediate rails 19. Conventional lock nuts 33 on the threaded lower ends of the bolts 32 rigidly fasten the plate 30 to the members 19 with the spacers 31 between them. The plate 30 is rigidly mounted approximately six (6) inches above the intermediate rails 19.

In the embodiment of the invention illustrated, the plate 30 is surmounted by four, vertically elongated guide tubes 40 which are welded to the plate around their lower extremities. The tubes 40 are each three inches in inside diameter, in the present illustration, and are symmetrically arranged around the plate 30 adjacent its four corners.

Figure 4:
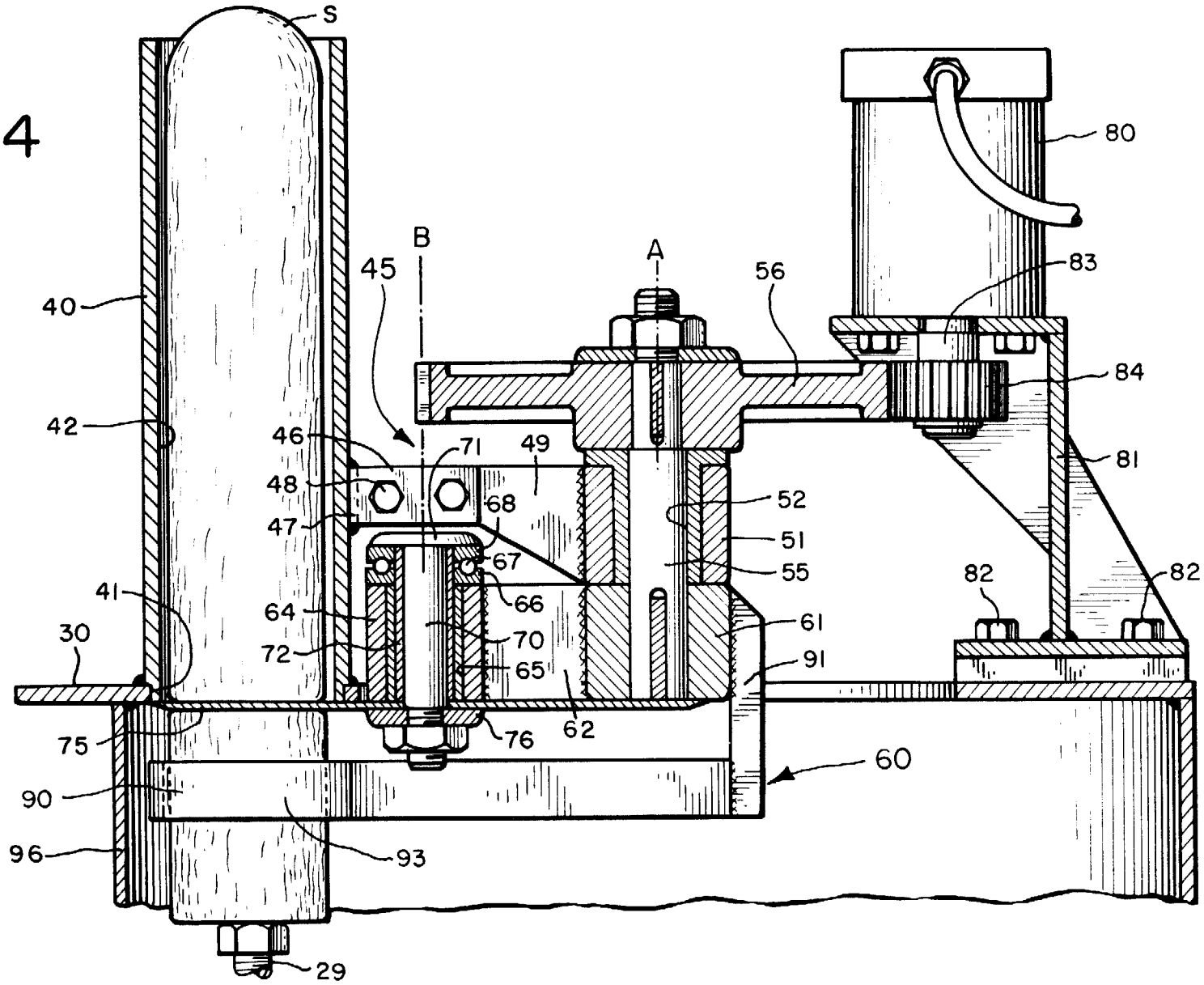
FIG. 4 is an enlarged sectional view taken along line 4—4 of FIG. 2, with parts removed.

The plate 30 has apertures 41 cut through it, as seen in FIG. 4. Each tube 40 is welded in a corresponding aperture 41. As a result, an uninterrupted cylindrical passage 42 is defined through each tube 40 and aperture 41.

As seen in FIG. 3, mounted between the four tubes is a spider 45. Turning to FIG. 4, it includes four radiating arms 45, each of which is welded to a corresponding tube 40 at its outer end, as at 47. Each arm 45 comprises an outer member 46 welded to a corresponding tube, and an inner member 49 which is bolted to the outer member 46 in a conventional manner with bolts 48.

The inner members 49 are welded to and radiate from a cylindrical bearing housing 51. The bearing housing 51 has a vertical bearing (passage) 52 extending through it on the vertical center line A of the cutting unit 12.

Rotatably mounted in the bearing 52 is a drive shaft 55. Affixed to the upper end of the drive shaft 55, above the bearing 52, is a ring gear 56. Affixed to the lower end of the shaft 55, below the bearing housing 51, is the blade and pusher assembly 60. Rotation of the ring gear 56 in a manner hereinafter described is effective to rotate the assembly 60 about the center line A of the cutting unit 12.

The blade and pusher assembly 60 includes a collar 61 which is affixed to the lower end of the shaft 55. Welded to the collar 61 and extending radially therefrom is a cutting blade arm 62. At the outer end of the cutting blade arm 62 is affixed a bearing sleeve 64.

The bearing sleeve 64 has a vertical bearing passage 65 extending through it. Mounted above the passage 65, on the bearing sleeve 64, is an annular ballbearing race 66. Ballbearings 67 seated in the race 66 support an upper ballbearing race 68. The upper ballbearing race 68, in turn, supports a blade mounting pin 70 which extends downwardly through the bearing passage 65 and is carried by the race 68 from an annular shoulder 71.

The shaft 70 is surrounded by a spacer sleeve 72 which extends from the shoulder 71 to a point very slightly below the bearing sleeve 64. Mounted on the shaft 70 below the bearing sleeve 64 is a circular cutting blade 75. The circular cutting blade is held tightly against the lower end of the spacer sleeve 72 by a conventional lock nut 76.

It is best seen in FIG. 4 that the positioning of the arm 62, and the dimensions of the spacer sleeve 72, together with corresponding dimensions of the other components, position the cutting blade 75 loosely against the bottom of the plate 30. The diameter of the blade 75 is such that it extends radially outwardly slightly beyond the circle inscribed by the outer periphery of each of the tubes 40.

Rotation of the ring gear 56 is effective to cause the arm 62 and thus the blade 75 to rotate around the axis A of the cutting unit 12. In doing so, as best seen in FIG. 2, the circular blade 75 successively passes under each of the tubes 40 in a "slicing" motion. Since the blade 75 is rotatably mounted on the pin 70, it tends to rotate and enhance the cutting effect in this slicing motion. Rotation of the blade 75 takes place around the center line B of the shaft 70.

The ring gear 56 is driven by a hydraulic motor 80 of conventional construction mounted on a bracket 81 fastened by bolts 82 to the base plate 30. The vertically depending drive shaft 83 of the motor 80 has a pinion gear 84 affixed thereto, in mesh with the ring gear 56. Actuation of the motor 80 in a conventional manner is effective to rotate the output shaft 83, thus rotating the ring gear 56 and, in turn, the blade and pusher assembly 60.

The blade 75 rotates around the axes A and B to effect slicing of predetermined length "chunks" of sausage, seen in dotted lines at S in FIG. 1. The lengths of sausage S are placed in each of the four tubes 40 and gravity pulls them downwardly to a point where they either engage the upper surface of the blade 75 or, if the blade is not in position below a tube at that time, through the opening in the lower end of the tube to a point where the sausage engages a stop bolt 29.

There are four stop bolts 29, as best seen in FIGS. 1 and 2. Each is mounted on a member 88 cantilevered from one of the intermediate rails 19. The stop bolts 29 are positioned by lock nuts 87 and 89 in a conventional manner so that the upper ends of the bolts 29 will, by their positioning, determine the extent to which each sausage protrudes below the plate 30. Thus the length of the chunk of sausage which is severed by the blade 75 may be adjusted.

As the blade 75 on its arm 62 orbits and rotates it successively cuts predetermined length chunks of sausage off below successive tubes 40. Each chunk which has been cut off is then toppled off the positioning bolts 29 by a pusher arm 90 component of the blade and pusher assembly 60.

The arm 90 is rigidly fixed to the eccentric arm hub or collar 61 by a depending bracket 91. As seen in dotted lines in FIG. 2, it extends generally parallel to the arm 62 supporting the blade 75. The outer end of the pusher arm 90 comprises a generally semi-circular sweep mouth 93 which partially encircles each severed chunk of sausage immediately after it is severed by the rotating blade and guides the chunk of sausage off the top of the positioning bolt 29, without permitting the chunk to move radially whereby the chunk falls off the positioning bolt into the waiting receptacle (not shown) below the unit.

The cutting operation of the blade 75 below the plate 30 is shielded by a cylindrical skirt 96 which depends from the periphery of the plate 30. The skirt 96 extends down to the top of the table 11, as best seen in FIG. 1.

An additional skirt 98 is provided depending from the base plate 30 around its periphery. The skirt 98, which is made up of four rectangular steel sheets 99, extends downwardly to the table 11 level also and affords a further barrier to access by the operator in the interest of safety.

I claim:

1. A machine for cutting up sausage-like food products such as pepperoni, Canadian bacon, salami and sausage and the like into chunks, comprising:

(a) a meat holder including a base plate having a plurality of apertures therethrough and also including a plurality of vertically oriented tubes for receiving individual sausage-like food products arranged around a vertical machine axis;

(b) said apertures including a first group of apertures over which corresponding ones of said tubes are mounted so that sausage-like food products inserted in said tubes are free to pass through said base plate;

(c) said apertures also including a central aperture disposed at said machine axis;

(d) a blade assembly rotatable about said machine axis and disposed below said plate on a drive shaft extending upwardly through said central aperture;

(e) said drive shaft being rotably supported from spider means above said plate;

(f) said spider means being mounted between said tubes;

(g) said blade assembly including a blade mounted for rotation about a vertical blade axis;

(h) said vertical blade axis being radially displaced from said machine axis; and (i) means for rotating said blade assembly about said machine axis.

2. A machine for cutting up sausage-like food products such as pepperoni, Canadian bacon, salami and sausage and the like into chunks, comprising:

(a) a meat holder including a base plate having a plurality of apertures therethrough and also including a plurality of vertically oriented tubes for receiving individual sausage-like food products arranged around a vertical machine axis;

(b) said apertures including a first group of apertures over which corresponding ones of said tubes are mounted so that sausage-like food products inserted in said tubes are free to pass through said base plate;

(c) said apertures also including a central aperture disposed at said machine axis;

(d) a blade assembly rotatable about said machine axis and disposed below said plate on a drive shaft to which it is fixed and which extends upwardly through said central aperture;

(e) said drive shaft being rotatably supported from means above said plate;

(f) said blade assembly including a blade mounted for free rotation about a vertical blade axis;

(g) said vertical blade axis being radially displaced from said machine axis;

(h) a food product stop fixed below each of said tubes and effective to limit the distance which a corresponding food product can protrude below said plate;

(i) a chunk pusher arm fixed to said shaft below said blade and including a sweep mouth which partially encircles the food product chunk after it is cut off and guides the chunk circumferentially as it forces the chunk off the stop; and (j) means for rotating said shaft to rotate said blade assembly and said pusher arm about said machine axis.

* * * * *